US007544874B2

(12) United States Patent
Hsieh

(10) Patent No.: US 7,544,874 B2
(45) Date of Patent: Jun. 9, 2009

(54) HEIGHT ADJUSTABLE KEY ASSEMBLY FOR A SAXOPHONE

(75) Inventor: Wu-Hong Hsieh, Lu Chou (TW)

(73) Assignee: K.H.S. Musical Instrument Co., Ltd., Lu Chou, Taipei Hsien (TW)

( * ) Notice: Subject to any disclaimer, the term of this patent is extended or adjusted under 35 U.S.C. 154(b) by 45 days.

(21) Appl. No.: 11/410,459

(22) Filed: Apr. 25, 2006

(65) Prior Publication Data

US 2007/0245879 A1 Oct. 25, 2007

(51) Int. Cl.
*G10D 9/04* (2006.01)

(52) U.S. Cl. ..... 84/385 R; 84/385 P; 84/453

(58) Field of Classification Search ..... 84/385 R, 84/380 R, 385 P, 422, 448–450, 453; D17/10, D17/13, 24, 99
See application file for complete search history.

(56) References Cited

U.S. PATENT DOCUMENTS 3,865,005 A * 2/1975 Carree ..... 84/380 R
4,328,734 A * 5/1982 Gebler ..... 84/380 R
5,949,007 A * 9/1999 Rumore
5,990,398 A * 11/1999 Nonaka ..... 84/385 R
5,990,399 A * 11/1999 Runyon ..... 84/385 R
6,225,541 B1 * 5/2001 Kodera et al. ..... 84/385 P
6,559,366 B1 * 5/2003 Takahashi ..... 84/380 R
6,591,740 B1 * 7/2003 Hsu ..... 99/349
2006/0283307 A1 * 12/2006 Lin ..... 84/385 R

* cited by examiner

*Primary Examiner*—Jeffrey Doneis
*Assistant Examiner*—Christopher Uhlir
(74) *Attorney, Agent, or Firm*—Charles E. Baxley

(57) ABSTRACT

A key assembly for a saxophone includes an elongated body adapted to be pivotal relative to a saxophone body and having a key formed on one end of the elongated body for selectively closing a hole in the saxophone body in response to the pivotal movement of the elongated body, a casing formed on the other end of the elongated body, a sliding block movably received in the casing from the top opening of the casing and having multiple positioning holes defined in a side face thereof, a key finger button to move simultaneously with the sliding block and a locking block threadingly extendable into the casing and having a locking pin to be extendable into one of the positioning holes of the sliding block so as to secure position of the sliding block as well as the key finger button relative to the elongated body.

2 Claims, 3 Drawing Sheets

HEIGHT ADJUSTABLE KEY ASSEMBLY FOR A SAXOPHONE

BACKGROUND OF THE INVENTION

1. Field of the Invention

The present invention relates to a height adjustable key assembly for a saxophone, and more particularly to the key assembly having a key finger button adjustably attached to one end of a body of the key assembly such that the player of the instrument is able to adjust the position of the key finger button to allow the player to play the instrument with the player's fingers at the most comfortable stretching positions.

2. Description of the Prior Art

When playing wind instruments, the player normally has to position his/her fingers on the key finger buttons to control movement of the keys, which generates various sounds as the keys are moved and wind flows through the holes in the body of the wind instruments.

It is well known in the art that finger lengths of the players differ dramatically when compared with one another so that some of the instrument players have to adjust their finger stretching amplitude to cope with the positions of the key finger buttons, which are fixed on the body of the wind instrument. Therefore, as a result of adapting to the positions of the key finger buttons, some players have to perform on the stage with awkward finger stretching angles.

To overcome the shortcomings, the present invention tends to provide an improved key assembly to mitigate the aforementioned problems.

SUMMARY OF THE INVENTION

The primary objective of the present invention is to provide an improved key assembly having a key finger button whose position is changeable relative to the body of the key assembly such that the player may change the position of the key finger button to adapt to the player's finger length.

In order to accomplish the above objective, the key assembly of the present invention includes an elongated body, a key integrally formed on one end of the body, a key finger button adjustably attached to the other end of the body and a position change device mounted between the body and the key finger button to change the position of the key finger button relative to the body. As a result, the key assembly of the present invention allows different players of different finger lengths to play with the instrument comfortably.

Other objects, advantages and novel features of the invention will become more apparent from the following detailed description when taken in conjunction with the accompanying drawings.

DETAILED DESCRIPTION OF THE PREFERRED EMBODIMENT

Figure 1:
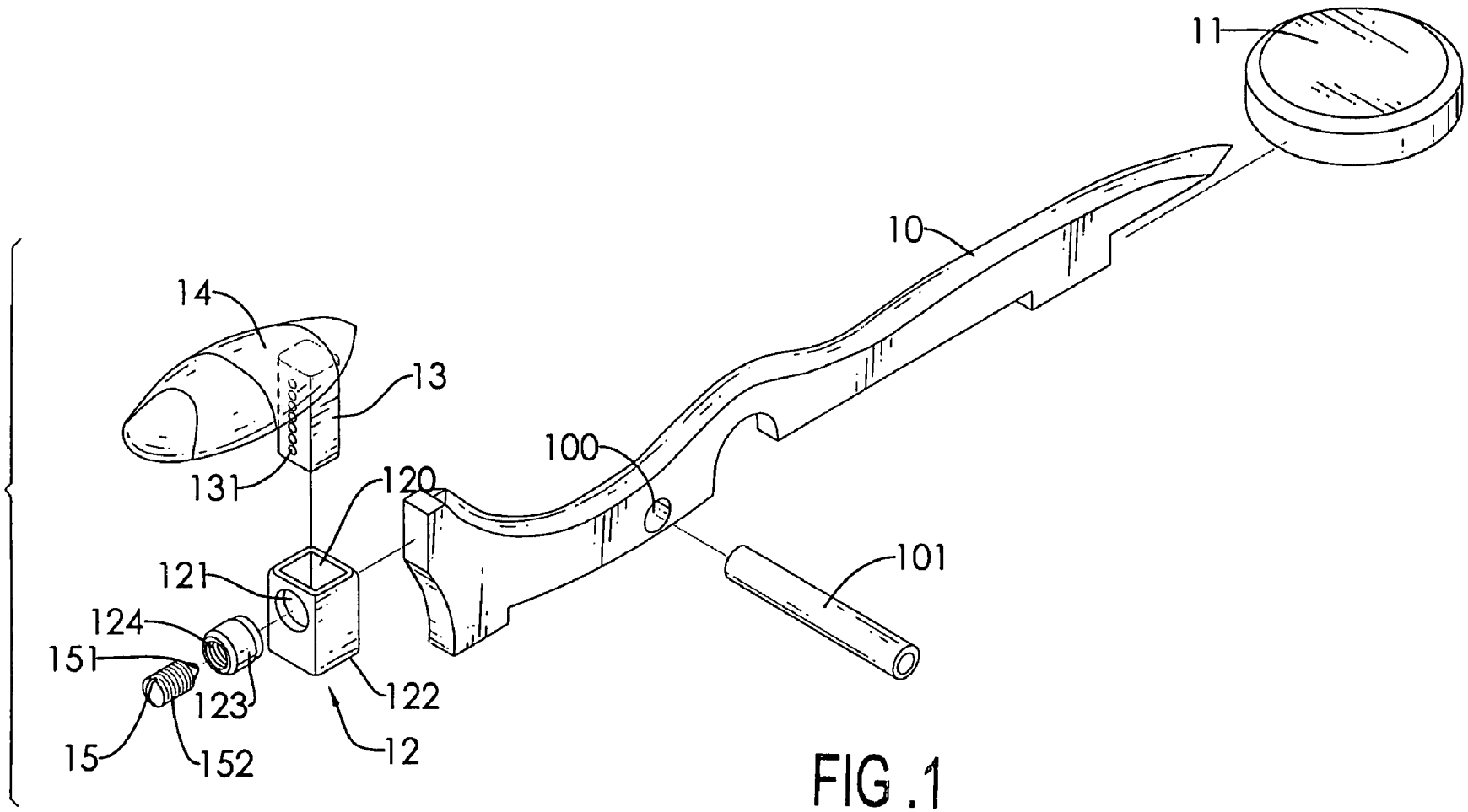
FIG. 1 is an exploded perspective view of the key assembly of the present invention.

With reference to FIG. 1, it is noted that the key assembly in accordance with the present invention includes an elongated body (10), a key (11) integrally formed on one end of the body (10), a casing(12) formed on the other end of the body (10), a sliding block (13) movable received in the casing (12) and a key finger button (14) securely attached to a top side of the sliding block (13).

The body (10) further has a pivot hole (100) defined in a mediate portion of the body (10) so that a pin (101) is able to extend into the pivot hole (100) and secured to an instrument body to allow the body (10) to pivot relative to the instrument body. Because what the appearance and structure of instrument may be are not the focus of the present invention, detailed description of how the body (10) pivots relative to the instrument body will not be described hereinafter.

The casing (12) is formed on the other end of the body (10) and has a top opening (120), a side opening (121) respectively defined in a top side and a lateral side of the casing (12) and a bottom surface (122) formed on a bottom side of the casing (12).

The sliding block (13) is received in the casing (12) and has multiple positioning holes (131) defined in a side face thereof to communicate with the side opening (1210 of the casing (12). The key finger button (14) is welded on top of the sliding block (13) so that the key finger button (14) is able to move together with the sliding block (13).

Furthermore, a sleeve (123) having therein an inner threading (124) is welded on a peripheral face defining the side opening (121) of the casing (12) and a locking block (15) is extendable through the sleeve (123), the side opening (121) and into an interior of the casing (12). The locking block (15) is cylindrical and has a locking pin (151) formed on an end thereof to correspond to one of the positioning holes (131) of the sliding block (13) and an outer threading (152) formed on an outer periphery of the locking block (15) to correspond to the inner threading (124) of the sleeve (123).

Figure 2:
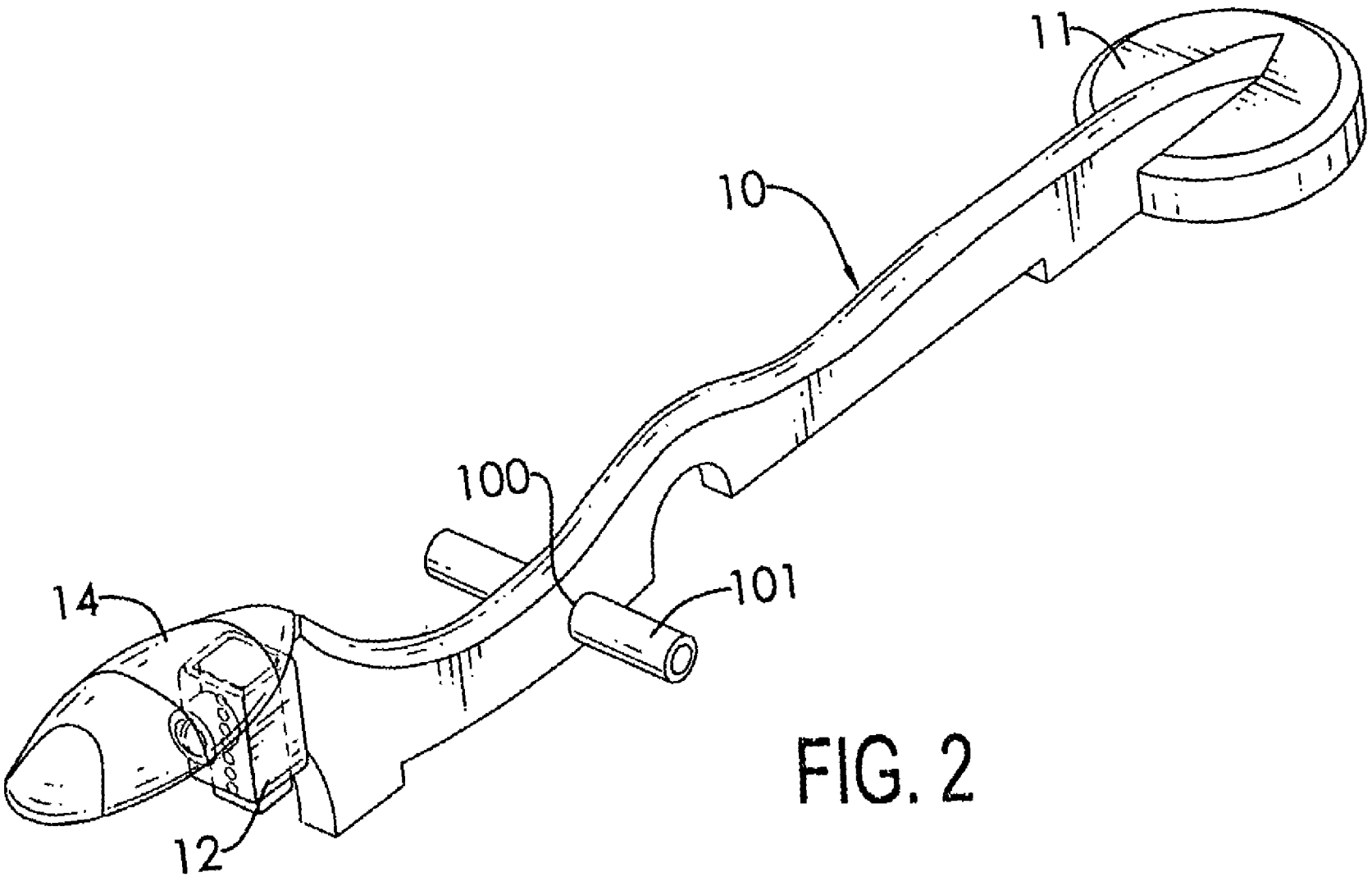
FIG. 2 is a perspective view of the key assembly after assembly.
Figure 3:
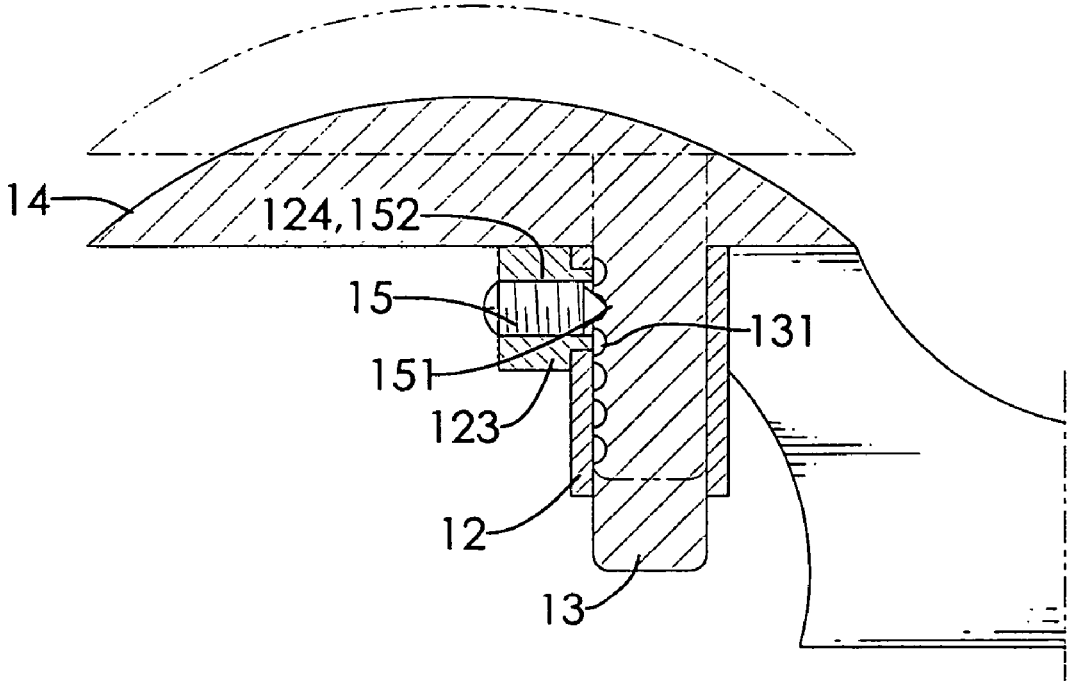
FIG. 3 is a schematic operational view showing that the position of the key finger button relative to the body is changed.

With reference to FIGS. 2, 3 and still using FIG. 1 for reference, it is noted that when the key assembly of the present invention is assembled, the sleeve (123) is welded on the periphery defining the side opening (121) of the casing (12) and the sliding block (13) is welded on the bottom of the key finger button (14). Furthermore, the sliding. block (13) is inserted into the interior of the casing (12) from the top opening (120) of the casing (12). Then the locking block (15) is threadingly extended through the sleeve (123) to allow the locking pin (151) to extend into a corresponding one of the positioning holes (131) of the sliding block (13). Thereafter, the key finger button (14) position relative to the body (10) is secured. However, if the player feels that the key assembly is not comfortable when playing the instrument, the player may unscrew the locking block (15) to allow the sliding block (13) as well as the key finger button (14) be movable relative to the casing (12). That is, the player may change the position of the combination of the key finger button (14) and the sliding block (13) relative to the body (10) by moving the sliding block (13) in the casing (12). After the position of the combination of the sliding block (13) and the key finger button (14) is adjusted, the player may screw the locking block (15) through sleeve (123) and into the casing (12) to once again secure the position of the combination of the key finger button (14) and the sliding block (13).

It is concluded that the position change of the combination of the key finger button (14) and the sliding block (13) allows the performer to comfortably play the musical instrument regarding the finger stretching amplitude.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A key assembly for saxophone, the key assembly comprising:

an elongated body adapted to be pivotal relative to a saxophone body and having a key formed directly on one end of the elongated body for selectively closing a hole in the saxophone body in response to pivotal movement of the elongated body;

a casing formed directly on the other end of the elongated body and having a top opening and a side opening respectively defined in a top face and a side face of the casing;

a sliding block being a rectangular cube with a top face, a bottom face and four side faces respectively perpendicular to the top and the bottom faces, movably received in the casing from the top opening of the casing and having multiple positioning holes defined and arranged on one of the side of the sliding block in a line;

only one key finger button integrally formed on top of the sliding block so as to move simultaneously with the sliding block; and a locking block threadingly extendable into the casing from the side opening and having a locking pin formed on one end thereof to be extendable into a corresponding one of the positioning holes of the sliding block so as to secure position of the sliding block as well as the key finger button relative to the elongated body.

2. The key assembly as claimed in claim 1 further comprising a sleeve integrally formed on a periphery defining the side opening of the casing and having an inner threading formed on an inner face of the sleeve to correspond to an outer threading formed on an outer periphery of the locking block so that the locking block is able to threadingly extend through the sleeve to allow the locking pin to extend into the corresponding positioning hole of the sliding block.

* * * * *